US009889962B2

(12) United States Patent
McDonald et al.

(10) Patent No.: US 9,889,962 B2
(45) Date of Patent: Feb. 13, 2018

(54) BLANK AND PACKAGING PRODUCED THEREFROM

(71) Applicant: DS Smith Packaging Deutschland Stiftung & Co. KG, Nuremberg (DE)

(72) Inventors: James McDonald, Edwalton (GB); Gert De Smedt, Heffen (BE); Fredrik Jacobsson, Saltsjobaden (SE)

(73) Assignee: DS Smith Packaging Deutschland Stifung & Co. KG, Nuremberg (DE)

( * ) Notice: Subject to any disclaimer, the term of this patent is extended or adjusted under 35 U.S.C. 154(b) by 0 days.

(21) Appl. No.: 15/033,632

(22) PCT Filed: Nov. 12, 2014

(86) PCT No.: PCT/EP2014/074397

§ 371 (c)(1),
(2) Date: Apr. 30, 2016

(87) PCT Pub. No.: WO2015/071326

PCT Pub. Date: May 21, 2015

(65) Prior Publication Data

US 2016/0280415 A1 Sep. 29, 2016

(30) Foreign Application Priority Data

Nov. 14, 2013 (DE) ..... 10 2013 112 565

(51) Int. Cl.
*B65D 5/22* (2006.01)
*B65D 5/54* (2006.01)
(Continued)

(52) U.S. Cl.
CPC ..... *B65D 5/22* (2013.01); *B65D 5/4283* (2013.01); *B65D 5/52* (2013.01); *B65D 5/548* (2013.01);
(Continued)

(58) Field of Classification Search
CPC ..... B65D 5/22; B65D 5/724; B65D 83/08; B65D 83/0817; B65D 83/0858; A47F 1/125; A47F 1/126
(Continued)

(56) References Cited

U.S. PATENT DOCUMENTS 2,937,742 A 5/1960 Michiel
4,020,946 A * 5/1977 Gardner ..... B65D 5/724 206/560
(Continued)

FOREIGN PATENT DOCUMENTS

DE 8328422.2 U1 1/1984
DE 20316963 U1 4/2005
(Continued)

OTHER PUBLICATIONS

International Preliminary Report on Patentability issued in International Application No. PCT/EP2014/074397 dated May 26, 2016.
(Continued)

*Primary Examiner* — Christopher Demeree
(74) *Attorney, Agent, or Firm* — McDonnell Boehnen Hulbert & Berghoff LLP

(57) ABSTRACT

The invention relates to a precut blank (1) consisting of a foldable material such as corrugated cardboard, paperboard or carton for producing automatically erectable packaging, in particular, a tray. The precut blank has a bottom (3) and hinged to it, two lateral panels (4), a rear panel (6) and a front panel (5), as well as two connecting flaps (7, 8) hinged to the front panel (5) and two hinged to the rear panel (6). According to the invention, an unstressed elastic element (15) is fastened at the connecting flaps (7) that are hinged to the front panel. Further, the invention relates to packaging erected from the precut blank (1).

20 Claims, 4 Drawing Sheets

(51) Int. Cl.

| | |
|---|---|
| ***B65D 5/66*** | (2006.01) |
| ***B65D 5/42*** | (2006.01) |
| ***B65D 5/72*** | (2006.01) |
| ***B65D 5/52*** | (2006.01) |

(52) U.S. Cl.
CPC ..... *B65D 5/6697* (2013.01); *B65D 5/724* (2013.01); *B31B 2201/26* (2013.01); *B31B 2201/267* (2013.01); *B31B 2201/9004* (2013.01); *B31B 2203/066* (2013.01); *B31B 2203/084* (2013.01)

(58) Field of Classification Search
USPC ..... 206/817; 221/279
See application file for complete search history.

(56) References Cited

U.S. PATENT DOCUMENTS

| | | | | |
|---|---|---|---|---|
| 4,844,331 | A * | 7/1989 | Oldfather | B65D 5/22 229/178 |
| 6,227,386 | B1 * | 5/2001 | Close | A47F 1/125 211/59.3 |
| 6,454,107 | B1 | 9/2002 | Belanger et al. | |
| 7,481,313 | B1 | 1/2009 | Kramedjian et al. | |
| 8,997,997 | B2 * | 4/2015 | Close | A47F 1/125 206/738 |
| 2004/0178157 | A1 | 9/2004 | Tse | |
| 2007/0108083 | A1 * | 5/2007 | Sonon | A47F 1/125 206/509 |

FOREIGN PATENT DOCUMENTS

| | | | |
|---|---|---|---|
| DE | 102004015701 | B3 | 7/2005 |
| DE | 102004015576 | A1 | 11/2005 |
| GB | 2407083 | A | 4/2005 |
| WO | 2014006398 | A2 | 1/2014 |

OTHER PUBLICATIONS

Search Report issued in Singapore Patent Application No. 11201603785X dated Nov. 2, 2016.

* cited by examiner

BLANK AND PACKAGING PRODUCED THEREFROM

CROSS REFERENCE TO RELATED APPLICATIONS

The present application is a 35 U.S.C. 371 National Application of PCT/EP2014/074397 filed Nov. 12, 2014, which claims priority to German Patent Application No. 10 2013 112 565.4, filed Nov. 14, 2013 the entire contents of which are incorporated entirely herein by reference.

The invention [relates to] a precut blank consisting of a foldable material such as corrugated cardboard, paperboard or carton for producing an automatically erectable packing, for example, a tray, and a packaging produced from such a precut blank. The precut blank has a bottom that is hinged to two lateral panels, a rear panel and a front panel, as well as, if applicable, two connecting flaps hinged to the front panel and two to the rear panel for connecting the lateral panels with the front panel and/or the rear panel.

DE 10 2004 015 576 A1 proposes a precut blank [and] a regal tray produced from it with an elastic retraction tool. The precut blank has a rectangular bottom to the four edges of which lateral panels, a rear panel and a front panel are hinged respectively. Two connecting flaps are provided at the rear panel for connecting the rear panel with the lateral panels. Further, connecting flaps are provided at the lateral panels for connecting the lateral panels with the front panel. Two ends of an elastic element are fastened to the front panel in such a way that the ends point toward each other and a loop of the elastic element lies in the interior of the erected tray. Additional flaps are provided at the front panel that can be folded onto the front panel in such a way that the ends of the elastic element lie between the flaps and the front panel. After the tray has been erected from the precut blank, the elastic element is fastened at the front panel and then, the flaps are folded onto the front panel. Subsequently, the elastic element is tensioned and products are filled into the tray so that the elastic element spans around these coming from the rear panel and along the lateral panels and pulls them toward the front panel. Hereby, the products within the tray are intended to be advanced automatically.

Furthermore, it is known to provide a slider within a tray or similar packaging that is pulled in the direction of the front panel of the tray by means of a closed elastic ring. U.S. Pat. No. 2,937,742 shows such a slider that can be pulled from an elastic ring fastened to the front panel—within the tray—from the rear panel in the direction of the front panel.

The as of yet unpublished international patent application PCT/GB2013/051755 describes a precut blank and a packaging of the type cited at the beginning. Hereby it is proposed to attach a strip consisting of elastic material in such a way that it serves as product advancing tool for products contained in the packaging. The fastening of the elastic strip is accomplished, for example, by gluing the unstressed strip onto the lateral panels of the partially erected packaging, whereby after that, the front panel of the packaging is erected and the connecting flaps are glued on the fastening area of the strip at the lateral panels. Alternatively, it is proposed to connect the elastic strip pre-tensioned prior to erecting the packaging with both lateral panels and the rear panel of the flat precut blank. The connection with the rear panel can, for example, be released upon opening the packaging. In the first alternative, the tensioning of the elastic strip takes place prior to erecting the front panel and to connecting the connecting flaps of the front panel with the lateral panels by inserting a cassette into the packaging through an opening range that is later to be closed by the front panel and hereby displaces the elastic strip. In this condition, the front panel can be closed and the packaging filled, Subsequently, the cassette is removed so that the elastic strip pushes the products within the packaging in the direction of the front panel.

It is the objective of the present invention to provide a precut blank and a packaging of the type cited at the beginning the production and handling of which is further improved during the filling of the package.

This problem is solved with the precut blank having the features of Claim 1. According to the invention, an unstressed elastic element is fastened at the connecting flaps hinged to the front panel of the precut blank. The elastic element can be a linear band, for example, and can, for example, be attached during the production of the precut blank already—or in a further processing step upstream to filling—be attached to the precut blank subsequently. In this way, the precut blank can be equipped particularly variably by attaching the elastic element with a feeder system. If the elastic element is attached in unstressed condition to the flat precut blank, the precut blank and the elastic element can be transported and stored just like a conventional precut blank without an elastic element. As the elastic element is attached to the precut blank in its unstressed condition, the precut blank is not subject to forces exerted by the elastic element during transport and storage, i.e. prior to the erection of the precut blank into a packaging that could lead to an unintended deformation or even damage of the precut blank. Beyond that, any creeping of the elastic element or a loosening of the connection between the elastic element and the precut blank is largely precluded.

According to a preferred embodiment of the invention the elastic element is a band consisting of a reversibly expandable material that covers the front panel at least partially.

Suitable materials include, among others, rubber or latex. Preferably, the band has two free ends that are respectively fastened at one of the two connecting flaps. Thereby, the free ends of the band preferably face away from each other so that the elastic element can be placed onto the connecting flaps and the front panel as a liner strip.

In order to facilitate the removal of products out of the packaging producible from the precut blank, a removal opening can be formed in the front panel and/or the bottom that covers the elastic element preferably at least partially. The removal opening can be entirely or partially closed by a flap that can be ripped open and torn off.

The handling of the packaging to be produced from the precut blank can be facilitated thereby, that the elastic element is lockable in a tensed condition. For this, according to a preferred embodiment of the invention, a detaining flap is hinged to the rear panel at the edge facing away from the bottom. Thereby, it is preferred when the width of the detaining flap that is delineated by free edges or groove lines or bending lines is smaller than the width of the bottom in the area between opposite lateral panels. In this way it is possible to fold the detaining flap onto the rear panel even when a tool holds the elastic element tensioned to the rear panel and, if applicable, abutting at the lateral panels. When the width of the detaining flap is only slightly smaller than the width of the bottom between the lateral panels, the elastic element extends nearly parallel to the lateral panels, which is preferred when products are being filled.

So that the elastic element is not damaged by the cutting edges of the detaining flap in its tensioned condition, fold-over flaps are hinged to the detaining flap at opposite edges. These can be folded onto the detaining flap prior to tensioning the elastic element and, if applicable, connected with such so that the edges of the detaining flap facing the lateral panels are smooth and rounded.

The detaining flap can be retained particularly easily in its position that stresses the elastic element when in the bottom of the precut blank, a locking flap is formed by means of cuts or cutouts that is unilaterally hinged to the bottom. This locking flap is preferably set back from the edge of the bottom with its free edge facing the rear panel to which the rear panel is hinged. Preferably, this free edge of the locking flap is set back by at least one, in particular, by at least twice the thickness of the material. When the locking flap—subsequent to the tensing of the elastic element and the fastening of the elastic element by means of the detaining flap—is deflected slightly out of the plane of the bottom, the detaining flap is pressed against the free edge of the locking flap by the elastic element and fixated in its position folded onto the rear panel.

In order to prevent that the detaining flap and/or the locking flap are unintentionally deflected into a position in which the elastic element can relax due to the force of the elastic element, snap means can be provided at the detaining flap and/or the locking flap. This can be accomplished, for example, by snap protrusions on the locking flap and corresponding recesses on the detaining flap.

The problem of the present invention is further solved by means of a packaging that is automatically unfolded into an erected usable condition from a precut blank of the type cited above out of a flat transport condition. Hereby, the elastic element is fastened between the connecting flaps hinged to the front panel and the lateral panels. In other words, the elastic element extends parallel in sections to the lateral panels in the erected packaging as the connecting flaps—at which the ends of the elastic elements are preferably fastened—are being folded onto the lateral panels. It is particularly preferred when the two free ends of the elastic element are thereby clamped between the connecting flaps and the lateral panels, glued with the connecting flaps and the lateral panels. The middle section of the elastic element that is not firmly attached to the connecting flaps and/or the lateral panels extends parallel to the front panel of the packaging in the unstressed condition of the elastic element. After the elastic element has been tensioned, this section of the element that is not firmly connected with the packaging preferably extends parallel to the lateral panels on the inside of the packaging up to the rear panel and is fixated parallel to it lying inside due to the detaining flap and/or the locking flap.

Additionally, the packaging can have a covering that closes the area opposite to the bottom after the packaging has been filled. For this, the covering can have a surface opposite to the bottom and circumferential panels hinged to it that cover the lateral panels, the rear panel and/or the front panel at least in sections. Additionally, in the cover surface, a tear strip can be provided that is delineated by a weakened line.

A further aspect of the present invention relates to a method for producing a packaging and a packaging produced from such, whereby the method includes the following steps: Providing a precut blank consisting of a foldable material that has a bottom and hinged to it two lateral panels, a rear panel and a front panel, subsequent fastening of an unstressed elastic element to the front panel or to the connecting flaps hinged to the front panel, subsequent erection of the lateral panels, the rear panel and the front panel out of a flat transport condition into an unfolded usable condition and connecting of the lateral panels with the rear panel and the front panel and subsequent tensioning of the elastic element. The production of a packaging in this sequence has the advantage that the precut blank can be transported and stored in a flat, space-saving transport condition. The elastic element can be attached variably, either directly after the production of the precut blank or only shortly before erecting the packaging out of the precut blank. In other words, the precut blank can be transported and stored with or without the elastic element. Further, it is hereby also possible to equip an elastic element and thus an advancing system for the packaging variably and individually. When the elastic element is tensioned after the erection and connection of the panels, the packaging already has sufficient stability that helps to prevent any damage during the tensing process due to the elastic element.

In the last step of the method, the elastic element is preferably tensioned in such a way that it extends on the inside of the packaging at least almost parallel to the lateral panels and the rear panel. This facilitates the filling the erected packaging.

Preferably, the elastic element is locked in its tensed condition after having been tensioned, Hereby, it is possible to temporarily store and/or transport the packaging that is prepared for filling to a fill station.

The locking of the elastic element can, for example, be accomplished thereby, that a detaining flap is hinged to the rear panel at the edge facing away from the bottom, whereby the elastic element is locked in its tensioned condition by fixing it between the rear panel and the detaining flap that is folded onto the rear panel after the elastic element has been tensioned. Hereby, it is preferred when a locking flap is formed in the bottom by cuts or cutouts, which is unilaterally hinged to the bottom. Thereby, the detaining flap is locked in its position folded onto the rear panel by deflecting the locking flap out of the plane of the bottom. The risk of damaging the elastic element can be minimized thereby, that fold-over flaps are hinged to the detaining flap at opposite edges that are folded onto the detaining flap and connected with it prior to tensing the elastic element, in particular, prior to erecting the packaging.

A further important aspect of the present invention relates to a system for producing a packaging out of a flat precut blank having a bottom that is hinged to two lateral panels, a rear panel and a front panel, as well as two connecting flaps on the front panel and two on the rear panel for connecting the lateral panels with the front panel and the rear panel. According to the invention, this system has at least one first station for erecting and connecting the lateral panels, the rear panel and the front panel as well as a second station downstream of the first station for tensioning an elastic element that is fastened with two ends at the precut blank. The configuration of the stations in sequence has the effect that the elastic element is tensioned only then, when the packing has already been erected completely and the panels of the packaging are connected with each other. This minimizes the risk of damaging the packaging due to the tensile forces of the elastic element and during the tensioning process of the elastic element.

The first station for erecting the panels can, for example, have a die that is adapted to the bottom in its contour. Additionally, the die can have, for example, suction elements so that the precut blank can be fastened to the die. The die can then be guided through a suitably designed matrix together with the precut blank so that hereby, the panels are deviated by approx. 90° relative to the bottom. Alternatively, it is also possible to deviate the panels individually relative to the bottom, by using corresponding manipulators.

The first station in which the panels are erected and connected with each other can have a further station upstream for fastening two ends of a relaxed, strip-shaped, elastic element onto the flat precut blank. This additional station upstream to the first station is not required to be present at the location of the first station. Rather, this upstream additional station can be provided at the production site of the precut blank so that the precut blank is delivered to the first station tion having an elastic element fastened to it already.

The second station in which the elastic element is tensioned preferably has at least two manipulators that are movable relative to the packaging erected in the first station. Preferably, these are equipped respectively to capture the elastic element away from its ends that are fastened to the precut blank and move along a path that has a directional component parallel to the lateral panels and a directional component parallel to the rear panel. For example, each manipulator can have a plate that is driven displaceable in a slotted piece guided by a plate, for example, an S-shaped slotted piece. Here, the term plate primarily means a flat two-dimensional element that can consist of metal or of another stiff or flexible material. Thereby, the capturing of the elastic element by the manipulators does not only include a tong-like gripping of the elastic element from two sides, but also the case that a manipulator comes to abut at the elastic element only on one side and displaces such. The movement of the elastic element in the two directional components can be a linear motion, for example, starting from an approximately middle section of the front panel into the two corners between the rear panel and the lateral panels. Alternatively, the movement can be along a bent and/or curved track. Hereby, it is particularly preferred when the manipulators are equipped in such a way that the elastic element is gripped at two off-center sections at the front panel and is pushed [into] the corners between the rear panel and the lateral panels. The contact point of the manipulators at the elastic element is preferably dimensioned in such a way that the expansion of the elastic element occurs evenly without requiring a relative motion between the elastic element and the manipulators. This can be accomplished thereby, that the distance between the manipulators at the start of the tensioning process corresponds to the distance of the manipulators in an evenly tensed condition.

It is especially preferred when the second station has a first unit for folding a detaining flap of the precut blank onto the rear panel and the tensioned elastic element and the second unit for deviating a locking flap of the precut blank relative to the bottom and the rear panel. Alternatively, the first unit and/or the second unit can also be provided in an additional station that is downstream of the second station.

A fill station for filling the erected packaging with products can be provided downstream of the second station. Thereby, it is preferred when a further unit is provided in the fill station for deviating a locking flap of the precut blank relative to the bottom that releases the locking of the detaining flap with the locking flap again.

In other words, directly after filling the packaging, the elastic element is released in such a way that it first pushes the products in the direction of the front panel via the detaining flap and after some products have been removed, it then slides off the detaining flap that then deviates toward the front panel and acts directly upon the products. Thereby, it is particularly preferred when the deflection of the locking flap in order to release the detaining flap is accomplished by the products themselves. The additional unit deviating the locking flap can thereby be the unit that inserts the products into the packaging.

In the following, the invention is described in further detail with the help of exemplary embodiments and by referring to the drawing. Schematically shown are:

Figure 12:
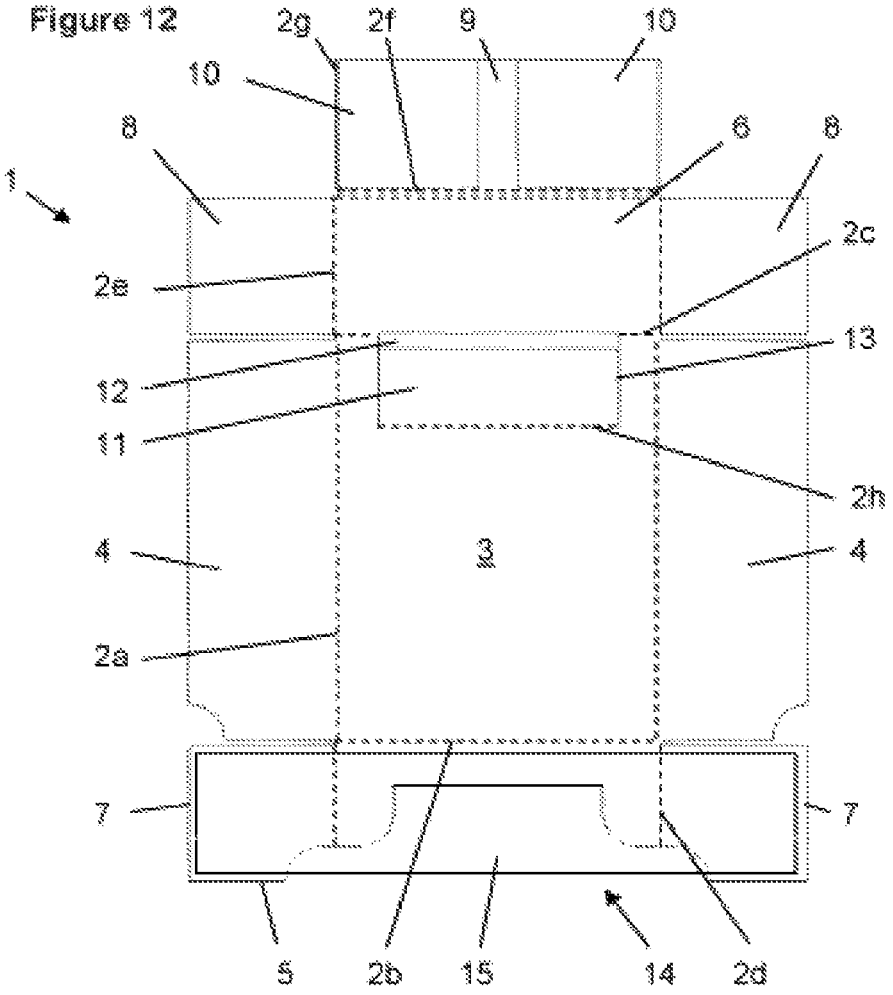

FIG. 12 shows an alternative design of the front panel 5 with a smaller removal opening 14 such that the pieces extending on both sides of the removal opening 14 are connected with each other by a piece of the front panel adjacent groove or banding line 2*b*.

Figure 1:
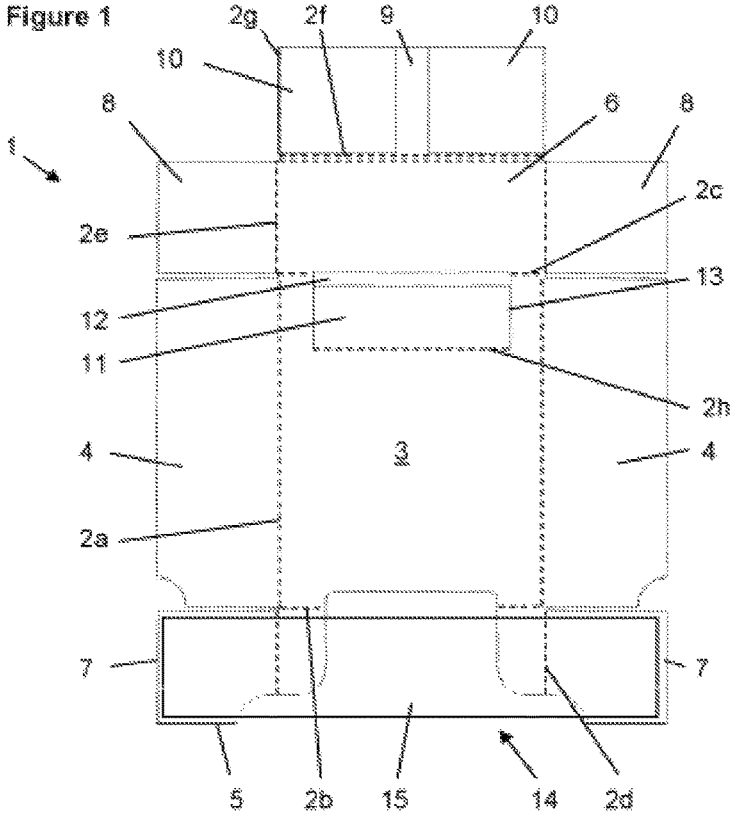
FIG. 1 shows a precut blank according to a first embodiment of the invention.

FIG. 1 shows a precut blank 1 in its flat transport condition. Precut blank 1 is provided with several groove or bending lines 2*a*, 2*b*, 2*c*, 2*d*, 2*e*, 2*f*, 2*g*, by means of which a bottom 3, lateral panels 4, a front panel 5, a rear panel 6, connecting flaps 7 and 8, a detaining flap 9 and fold-over flaps 10 are defined.

As shown in FIG. 1, bottom 3 in the embodiment shown, is designed rectangular, as the groove or bending lines 2*a*, 2*b*, 2*c* that define bottom 3 extend perpendicular to each other. On the right and on the left side of bottom 3 in FIG. 1, the substantially rectangular lateral panels 4 are hinged in deflectable manner. Therefore, lateral panels 4 are integrally connected with bottom 3. Front panel 5 is hinged to the lower side of bottom 3 in FIG. 1, whose lateral edges are likewise defined by groove or bending lines 2*d*, by which connecting flaps 7 are hinged to front panel 5. Even front panel 5 with connecting flaps 7 is thus integrally connected with bottom 3. The upper side of bottom 3 in FIG. 1 is hinged to rear panel 6 by a groove or bending line. The lateral edges of rear panel 6 are in turn defined by groove or bending lines 2*e*, by means of which connecting flaps 8 are hinged to rear panel 6. To the upper side of rear panel 6 in FIG. 1, detaining flap 9 is hinged via a double groove or bending line 2*f* that is in turn connected with fold-over flaps 10 by lateral groove or bending lines 2*g*. In this way, rear panel 6, connecting flaps 8, detaining flap 9 and fold-over flap 10 are likewise integrally connected with bottom 3.

In the embodiment shown in FIG. 1, groove or bending lines 2*d*, 2*e* that connect connecting flaps 7 and 8 with front panel 5 and/or rear panel 6 are located offset outward with respect to groove or bending lines 2*a* that connect bottom with lateral panels 4 by approximately one thickness of the material.

This has the effect that while erecting precut blank 1 into a packaging, connecting flaps 7 can be fastened on the outside of lateral panels 4 without causing any warping of the packaging.

In the embodiment shown, a locking flap 11 is formed in bottom 3 by providing a recess 12 in the area of groove or bending line 2*c* that connects bottom 3 with rear panel 6—and relative to it—cuts 13 extending substantially rectangular are formed in bottom 3. Via a further groove or bending line 2*h*, locking flap 11 is connected with bottom 3 in deflectable manner.

In the embodiment shown, a removal opening 14 is provided in front panel 5 that extends slightly beyond grove and bending line 2 connecting bottom 3 and the front panel into the area of bottom 3. Removal opening 14 is provided in the middle of front panel 5 in the embodiment shown, so that crosspieces of front panel 5 extend on both sides of removal opening 14.

FIG. 12 shows an alternative design of the front panel 5 with a smaller removal opening 14 such that the pieces extending on both sides of the removal opening 14 are connected with each other by a piece of the front panel adjacent groove or banding line 2*b*.

Precut blank 1 according to the invention is provided with an elastic element 15 that is a strip or a band consisting of latex in the embodiment shown. Essentially, plastic band 15 has the width of front panel 5, including connecting flaps 7, so that the elastic band 15 can be placed onto connecting flaps 7 and front panel 5, whereby the free ends of elastic band 5 come to lie approximately near the free lateral edges of connecting flaps 7. In the embodiment shown, elastic band 15 is glued to the two connecting flaps 7, so that a middle section of elastic band 15 that partially covers the front panel and removal opening 14, lies loosely on precut blank 1, fastened only at both ends.

Figure 2:
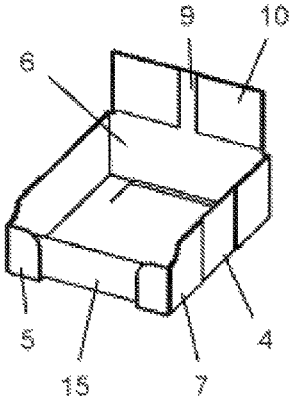
FIG. 2 shows a packaging erected from a precut blank according to FIG. 1 with an unstressed elastic element.

In the following, erecting a packaging according to the invention from the precut blank according to FIG. 1 will be explained in further detail. For this, first lateral panels 4 and front panel 5, as well as rear panel 6 are deflected by approximately 90° relative to bottom 3. Subsequently, connecting flaps 7 and 8 are likewise deflected by approximately 90° and fastened from the outside on erected lateral panels 4. Advantageously, this can be accomplished by adhesion. Alternatively, this can be accomplished by means of clamps, for example. In this way, the lateral ends of elastic band 15 are clamped between connecting flap 7 and the outer side of lateral panels 4 and connected with the respective connecting flap 7, as well as with the respective lateral panel 4. Elastic band 15 thus extends in sections along erected lateral panels 4 and lies inside parallel to front panel 5, however, without being firmly connected with it. This condition is illustrated in FIG. 2.

Figure 3:
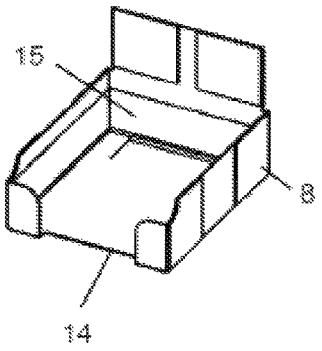
FIG. 3 shows the packaging according to FIG. 2 with a tensioned elastic element.

Elastic band 15 can now be tensioned. Hereby, it has been shown to be advantageous that the packaging has already been erected completely and the lateral panels are connected with front panel 5 and rear panel 6 so that the packaging has sufficient stability. As described in further detail below, the elastic band is tensioned in such a way that—as shown in FIG. 3—it extends lying inside approximately parallel to the lateral panels and parallel to rear panel 6. In this condition, detaining flap 9 can be deflected inward by 180° so that it clamps elastic band 15 between itself and rear panel 6. Previously, the fold-over flaps 10 have been folded onto detaining flap 9 so that the fold-over flaps 10 abut at elastic band 15.

In this position, detaining flap 9 can be locked against the tension of elastic band 15 by slightly deflecting locking flap 11 upward out of the plane of bottom 3. Hereby, the free edge of locking flap 11 that faces rear panel 6 pushes against the lower side of detaining flap 9 at close to a right angle—FIG. 4—and thus prevents that detaining flap 9 is deflected forward or upward by the reset force of elastic band 15 in FIG. 4.

Figure 4:
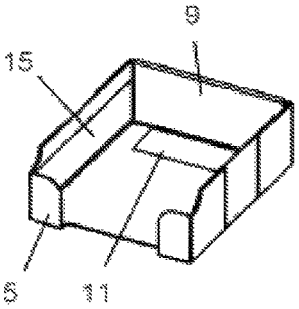
FIG. 4 shows the packaging according to FIG. 2 with a tensioned and locked elastic element.

In the condition of the packaging shown in FIG. 4, it can be filled. As a result of filling the packaging, the products exert pressure on locking flap 11 so that it is pushed back into its initial position in which it extends at the level of the bottom 3. Thus, by means of the filling process, the locking of detaining flap 9 by locking flap 10 is released again. Elastic band 15 thus presses products contained in the packaging toward the front panel and the removal opening 14 via detaining flap 9.

When individual products are now removed through the removal opening, or upward out of the packaging, the elastic band 15 first presses the products still remaining in the packaging further toward front panel 5 via detaining flap 9. After some products have been removed from the packaging, detaining flap 9 is deflected to such a degree due to the reset force of elastic band 15 that it extends, for example, approximately parallel to bottom 3. Shortly before reaching this condition, elastic band 15 slides off detaining flap 9 and exerts a tensile force directly upon the products still remaining in the packaging toward front panel 5. Elastic band 15 thus surrounds the products remaining in the packaging laterally and from the rear. Hereby, it is prevented that the products, for example, bar-like products tip over in the packaging and are thereby more difficult to identify or to remove by a consumer through removal opening 14.

In FIG. 2 through 4, the packaging erected out of precut blank 1 is shown in the form of an open tray (chute). After filling, the tray can be closed by a cover that has a surface opposite to bottom 3 and circumferential panels hinged to it. The circumferential panels can, for example, abut outside on lateral panels 4 and rear panel 6. A further circumferential panel can be inserted into the packaging so that it abuts inside at the front panel and thus closes removal opening 14. Alternatively, it is also possible to locate this additional circumferential panel lying outside on the front panel. Preferably, at least one section of the covering surface and/or the circumferential panel associated with the front panel of the cover is designed to be ripped open or torn off so that the packaging provided with the cover can be opened easily.

The process of tensioning elastic band 15 and locking elastic band 15 by means of detaining flap 9 and locking flap 11 will be explained in further detailed in the following by referring to FIG. 5 through 8. These Figures show a station in which, the erected packaging as shown in FIG. 2 is inserted and converted into the condition shown in FIG. 4

Figure 5:
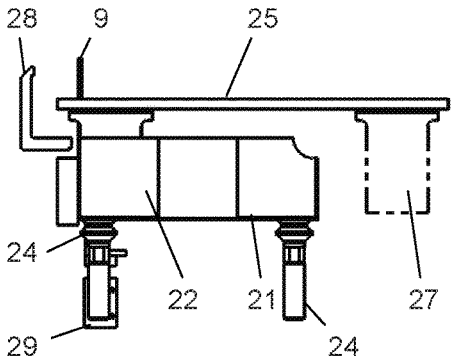
FIG. 5 shows a station for tensioning the elastic element in lateral view.
Figure 6:
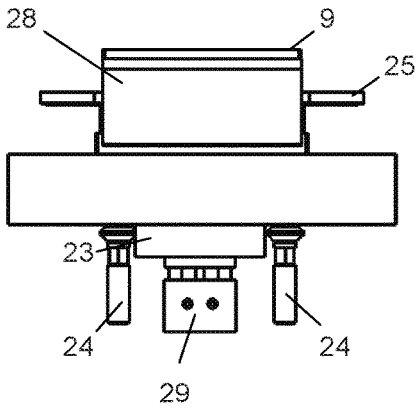
FIG. 6 shows a front view of the station according to FIG. 5.

For this purpose, station 20 first of all has an adapter for the packaging that is formed by a bottom 21, lateral walls 22 and a rear wall 23. Thus the adapter in FIG. 5 is open on the right side so that the packaging can be inserted into the adapter. In the embodiment shown, four openings are provided in bottom 21, through which suction elements 24 can retain bottom 3 of the packaging within the adapter.

Figure 7:
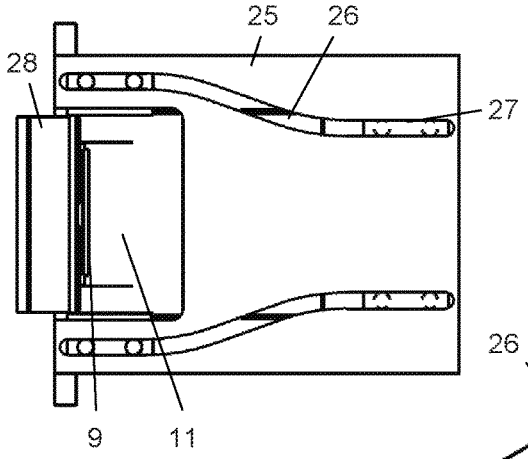
FIG. 7 shows a top view of the station according to FIG. 5.

A plate 25 having two guide plates 26 is provided above the adapter. In the embodiment shown, guide plates 26 are shown as an opening or slot that is approximately S-shaped in which a plate 27 can be guided displaceable. Plates 27 can be displaced from the position on the right shown as dotted lines into the position on the left that is shown as solid lines in FIG. 5 by means of a drive that is not shown in further detail. In FIG. 7, the two bearings of plates 27 are also shown by two dotted lines or two solidly outlined circles in the various positions of the plates respectively.

Guide plates 26 in plate 25 are designed in such a way that plates 27 can enter through removal opening 14 in front panel 5 into the packaging. Hereby, elastic band 15 comes to abut with the—in FIG. 5—left edge of the respective plate 27. Thus, plates 27 serve as manipulators that push the elastic band into the corners of lateral panels 4 with rear panel 6, as plates 27 are moved to the left in FIG. 5, along guide plate 26. In this way, elastic band 15 is tensioned. Plates 27 are preferably designed thin so that plates 27—in their position to the left in FIG. 5—abut as closely as possible inside at lateral panels 4 without thereby impeding the folding over of detaining flap 9.

Figure 8:
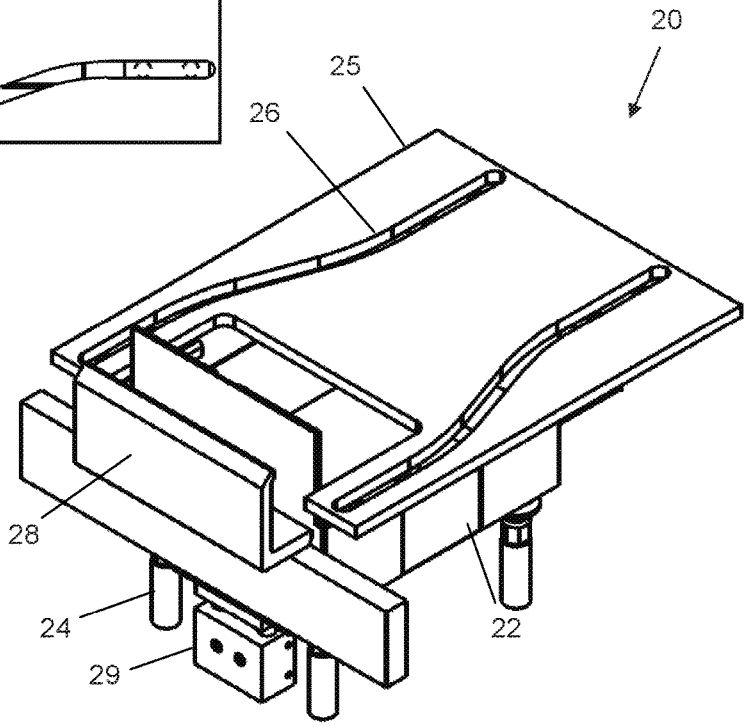
FIG. 8 shows a perspective view of the station according to FIG. 5.

For this, an angle 28 is provided in station 20 whose width—as shown in FIG. 8—approximately corresponds to that of detaining flap 9. Angle 28 can be deflected clockwise from its position shown in FIG. 5 via a drive that is not shown in further detail, so that the longer, perpendicular leg of angle 28 in FIG. 5 contacts detaining flap 9 and folds it onto rear panel 6. In other words, in operation, angle 28 brings detaining flap 9 out of the position shown in FIG. 3 into the position shown in FIG. 4.

Figure 9:
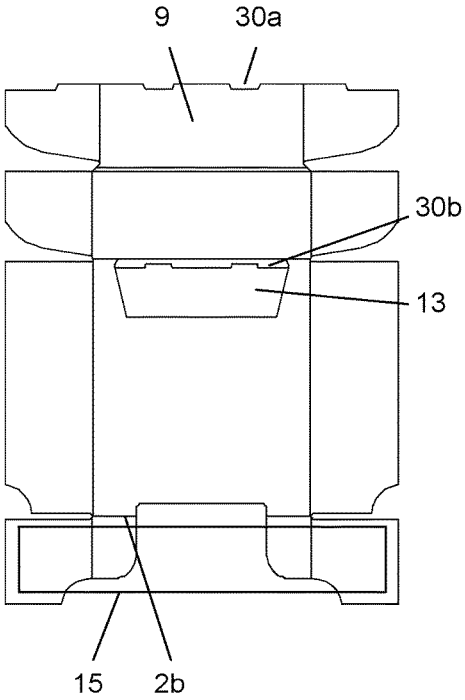
FIG. 9 shows a precut blank according to a second embodiment of the invention.
Figure 11:
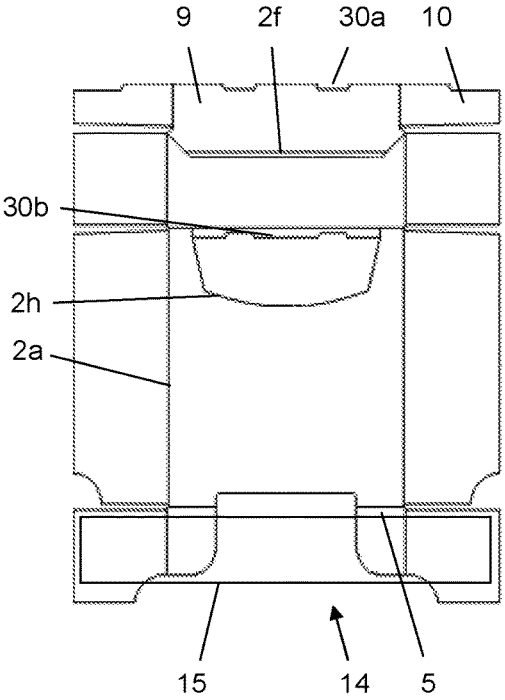
FIG. 11 shows a precut blank according to a third embodiment of the invention.
Figure 10:
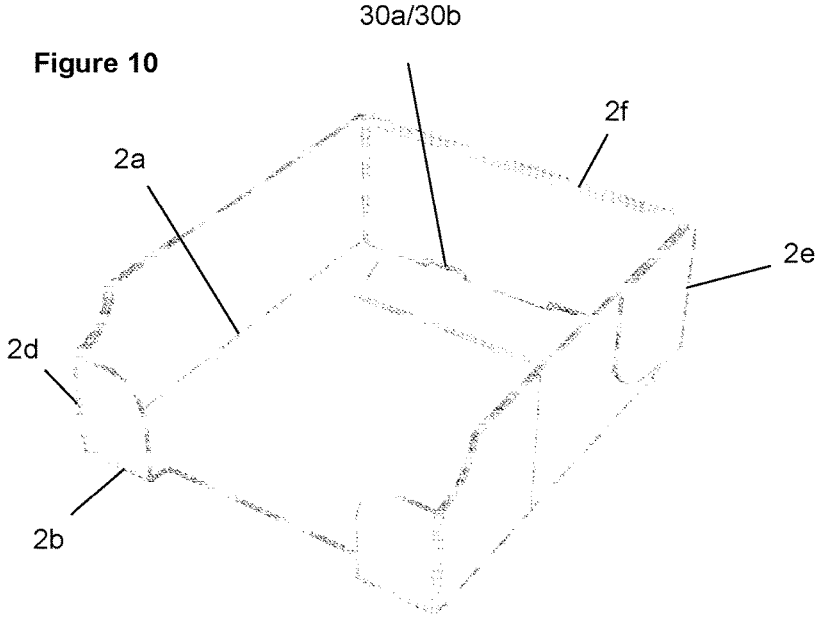
FIG. 10 shows a packaging erected from a precut blank according to FIG. 9.

Further, a cylinder unit 29 is provided in station 20, whose plunger can act upon locking flap 11 of the packaging through an additional opening in bottom 21. After the folding over of detaining flap 9, cylinder unit 29 is activated and thereby slightly deflects locking flap 11 out of its position lying at the level of bottom 3 into the interior space of the packaging, so that the free edge of the locking flap 11 comes in contact with the lower side of detaining flap 9. Alternative to the free edge, a serration can be provided as shown in FIGS. 9 through 11. This prevents that the detaining flap 9 is deflected back due to the force of elastic band 15 when angle 28 returns to its initial position shown in FIG. 5 and plates 27 are returned again to the position shown on the right in FIG. 5. Thus, the packaging is in a condition according to FIG. 4 in which the packaging can be filled.

Differing from the embodiment of precut blank 1 described above and station 20 it is alternatively also possible to dispense with detaining flap 9, fold-over flaps 10 and/or locking flaps 11. In this case, elastic band 15 is tensioned by plates 27 as described above and the packaging must then be filled while plates 27 hold elastic band 15 tensed. Thereby, elastic band 15 acts directly upon the products after filling as soon as plates 27 no longer engage band 15.

Station 20 can also have an additional station upstream—not shown in the Figures—in which the packaging is erected from precut blank 1 and glued. This upstream station can, for example, be designed as described in the as of yet unpublished international patent application PCT/GB2013/051755.

Elastic band 15 can be placed on precut blank 1 in a unit upstream of station 20. This can be accomplished thereby, for example, that from a coil that has a width corresponding approximately to the distance of the free lateral edges of connecting flaps 7, elastic band material is uncoiled and placed on the substrate. This substrate is preferably connected with a suction unit so that the uncoiled material is retained on the substrate. On this substrate, the uncoiled material can then be cut into strips having a height that is suitable for advancing the products in the packaging. This custom-cut strip can then be fed to precut blank 1 and together with it, glued to connecting flaps 7.

FIGS. 9 and 10 show a second embodiment having a structure that is very similar to the first embodiment. However, on the upper side of detaining flap 9 in FIG. 9, cutouts 30*a* are provided. Corresponding cutouts 30*b* are also provided at the free edge of the locking flap 6 that faces rear panel 6. As shown in FIG. 10, in which elastic band 15 was omitted for reasons of clarity, these cutouts 30*a*, 30*b* have the effect of a serration that prevents—in the erected condition of locking flap 11—that it can be pushed out of the position locking detaining flap 9 due to the force of elastic band 15. In other words, locking flaps 11 and detaining flap 9 snap into each other in order to secure elastic element 15 via detaining flap 9.

A modification of this embodiment is shown in FIG. 11. Hereby, first of all, the groove or bending line 2*h* by means of which locking flap 11 is connected with bottom 3 is designed curved. This increases the reset force. Additionally, cuts 13 are formed slanted. Regardless of that, rear panel 6 is designed shortened compared with the other embodiments.

Correspondingly, the height of fold-over flaps 10 is also lower. In order to avoid a sharp edge with connecting flaps 8, the double groove or bending line 2*f* therefore does not extend over the entire width of rear panel 6 and starting from the ends of double groove or bending line 2*f*, slanted cuts extend to the respective edges of connecting flaps 8.

REFERENCE NUMBERS:

1 Precut blank
2*a-h* Groove or bending line
3 Bottom
4 Lateral panel
5 Front panel
6 Rear panel
7 Connecting flap
8 Connecting flap
9 Detaining flap
10 Fold-over flap
11 Locking flap
12 Recess
13 Cut
14 Removal opening
15 Elastic element (band)
20 Station
21 Bottom
22 Lateral wall
23 Rear wall
24 Suction element
25 Platte
26 Guide plate
27 Plate (manipulator)
28 Angle
29 Cylinder unit
30*a,b* Cutout

What is claimed is:

1. A precut blank comprising a foldable material for producing automatically erectable packaging, whereby the precut blank has a bottom and hinged to it, two lateral panels, a rear panel and a front panel, as well as two connecting flaps hinged to the front panel and two to the rear panel for connecting the lateral panels with the front panel and the rear panel, wherein an unstressed elastic element is fastened at the connecting flaps that are hinged to the front panel; and the unstressed elastic element comprises an elastic band having free ends facing away from each other with the unstressed elastic band being placed onto the two connecting flaps and the front panel as a liner strip in a flat transport condition of the blank.

2. The precut blank as recited in claim 1, wherein the elastic element comprises a band comprising a reversibly stretchable material that has two free ends that are respectively fastened to one of the two connecting flaps that covers the front panel at least partially.

3. The precut blank of claim 2, wherein the reversibly stretchable material comprises a rubber.

4. The precut blank of claim 2, wherein the reversibly stretchable material comprises a latex.

5. The precut blank as recited in claim 1, wherein a removal opening is formed in the front panel, whereby the elastic element covers the removal opening at least partially.

6. The precut blank as recited in claim 1, wherein at the rear panel a detaining flap is hinged at the edge facing away from the bottom, the width of which is delineated by free edges or groove lines or bending lines and is smaller than the width of the bottom between the lateral panels that are opposite to each other.

7. The precut blank as recited in claim 6, wherein fold-over flaps are hinged to the detaining flap at opposite edges.

8. The precut blank as recited in claim 1, wherein in the bottom, a locking flap is formed by cuts or cutouts that is unilaterally hinged to bottom.

9. The precut blank as recited in claim 8, wherein a free edge of the locking flap is set back by at least one the thickness of the material from the edge of the bottom that is hinged to the rear panel.

10. The precut blank as recited in claim 9, wherein snap means are provided at the detaining flap and/or the locking flap.

11. A packaging that is erected automatically from a precut blank as recited in claim 1 from a flat transport condition into an unfolded usable condition wherein the elastic element is fastened between the connecting flaps hinged to the front panel and the lateral panels.

12. The packaging as recited in claim 11, that additionally comprises a cover having a surface opposite to the bottom and hinged to it, circumferential panels that at least partially cover the lateral panels, the rear panel and/or the front panel, whereby a tear-off strip that is delineated by a weakened line is provided in the surface.

13. The precut blank of claim 11, wherein the packaging comprises a tray.

14. The precut blank as recited in claim 13, wherein in the bottom, a locking flap is formed by cuts or cutouts that is unilaterally hinged to bottom, and wherein a free edge of the locking flap is set back by at least one, in particular, by at least twice the thickness of the material from the edge of the bottom that is hinged to the rear panel.

15. The precut blank of claim 1, wherein the automatically erectable packaging comprises a tray.

16. The precut blank of claim 1, wherein the foldable material comprises a corrugated cardboard for producing automatically erectable packaging.

17. The precut blank of claim 1, wherein the foldable material comprises a paperboard for producing automatically erectable packaging.

18. The precut blank of claim 1, wherein the foldable material comprises a carton for producing automatically erectable packaging.

19. A precut blank comprising a foldable material for producing automatically erectable packaging whereby the precut blank has a bottom and hinged to it, two lateral panels, a rear panel and a front panel, as well as two connecting flaps hinged to the front panel and two to the rear panel for connecting the lateral panels with the front panel and the rear panel, wherein an unstressed elastic element is fastened at the connecting flaps that are hinged to the front panel, and wherein at the rear panel a detaining flap is hinged at the edge facing away from the bottom, the width of which is delineated by free edges or groove lines or bending lines and is smaller than the width of the bottom between the lateral panels that are opposite to each other.

20. The precut blank as recited in claim 19, wherein fold-over flaps are hinged to the detaining flap at opposite edges.

* * * * *